US005611436A

United States Patent [19]

Ashby

[11] Patent Number: 5,611,436

[45] Date of Patent: Mar. 18, 1997

[54] PC CARD CONVEYANCE AND TESTING APPARATUS

[76] Inventor: Harrel D. Ashby, 11913 Rosemeade Ct., Oklahoma City, Okla. 73162

[21] Appl. No.: 501,773

[22] Filed: Jul. 13, 1995

[51] Int. Cl.[6] ..... B07C 5/344

[52] U.S. Cl. ..... 209/573; 209/911

[58] Field of Search ..... 209/573, 571, 209/572, 574, 911, 924

[56] References Cited

U.S. PATENT DOCUMENTS

| | | | |
|---|---|---|---|
| 4,644,427 | 2/1987 | Ashby | 360/98 |
| 4,654,732 | 3/1987 | Mesher | 360/98 |
| 4,688,124 | 8/1987 | Scribner et al. | 360/99 |
| 4,693,659 | 9/1987 | Burke et al. | 414/131 |
| 4,813,838 | 3/1989 | Santeusanio | 414/798.1 |
| 5,050,023 | 9/1991 | Ashby | 360/98.06 |
| 5,348,164 | 9/1994 | Heppler | 209/911 X |

*Primary Examiner*—David H. Bollinger
*Attorney, Agent, or Firm*—Dougherty, Hessin, Beavers & Gilbert

[57] ABSTRACT

Apparatus for handing and testing PC cards and, more particularly, modem cartridge units. The apparatus uses a gravity drop conveyance or slideway in combination with transverse test coupling unit. Feed gate apparatus separates and singly drops each PC card for drop down the chassis slideway and into a test position beneath a test box. The test box is then actuated transversely to connect test plugs to each side of the PC card which then undergoes a predetermined test sequence. Test PC cards are then further dropped along to slideway to separation and classification stages.

13 Claims, 6 Drawing Sheets

PC CARD CONVEYANCE AND TESTING APPARATUS

BACKGROUND OF THE INVENTION

1. Field of the Invention

The invention relates generally to apparatus for tracking and positioning PC card devices in rapid succession and, more particularly, but not by way of limitation, it relates to an improved testing device for receiving and testing PC card devices in rapid succession with rejection of faulty devices.

2. Description of the Prior Art

The closest prior art should be the U.S. Pat. No. 5,050,023 entitled "DISKETTE SEQUENTIAL LOADING AND STORING APPARATUS" as issued on Sep. 17, 1991 in the name of H. D. Ashby, the present inventor. This patent describes a device for handling storage diskette members utilizing a magazine that directs diskettes alternately along dual drop chutes whereupon the individual diskettes are each tested in a disk drive apparatus. Means are then provided for directing tested diskettes along selected routing as designated for non-defective and defective diskette containers. Another U.S. Pat. No. 4,644,427 in the name of the same inventor and entitled "DISKETTE LOADING APPARATUS" would be of general interest as it relates to testing and handling apparatus for diskettes. This loading apparatus also utilizes a gravity drop delivery chute which functions in coaction with a disk drive apparatus for sorting and processing. Other patents having some pertinence to the present invention are included in the Information Disclosure Statement.

SUMMARY OF THE INVENTION

The present invention provides an improved cartridge-type loading apparatus for handling, testing and sorting modular PC cards of various types. Each of the PC cards is encased in a standard jacket or wrapper as the pin connections will vary as between the PC cards of different manufacturers. The testing apparatus functions by programmed pneumatic operation to enable electronic testing of modem operation in rapid manner whereby defective and non-defective modems are separated. Modems to be tested are aligned in an input storage chute whereupon the units are successively fed into a gravity-drop slideway. A modem under test progresses down the slideway under control of pneumatic stops through a ready station for intermittent release into a test station whereupon a transverse slide actuator carries the modem into plug interconnection for performance of the test sequence. Upon test completion, the transverse cylinder is reversed whereupon the modem interconnection is broken and released, and the modem continues down the slideway under force of gravity into a first test deposit chute which holds valid tested units, or, it continues on downward to a reject deposit chute if the unit did not pass the clearance test. It should be understood that, while reference is made to modem units, any type of PC card may be tested in the present apparatus.

Therefore, it is an object of the present invention to provide a PC card test apparatus that handles all units in standard wrapper rapidly and safely.

It is also an object of the present invention to provide a PC card testing apparatus that utilizes a gravity drop input mechanism.

It is yet further an object of the invention to provide handling and testing apparatus for handling modem modules in rapid and efficient manner to separate the good modems from the defective.

Finally, it is an object of the present invention to provide a pneumatically controlled, gravity-drop slideway to present standard modem units for electronic testing of operational components.

Other objects and advantages of the invention will be evident from the following detailed description when read in conjunction with the accompanying drawings which illustrate the invention.

BRIEF DESCRIPTION OF THE DRAWINGS

FIG. 8 is a vertical section taken along lines 8—8 of FIG. 1;

DETAILED DESCRIPTION OF THE INVENTION

Figure 1:
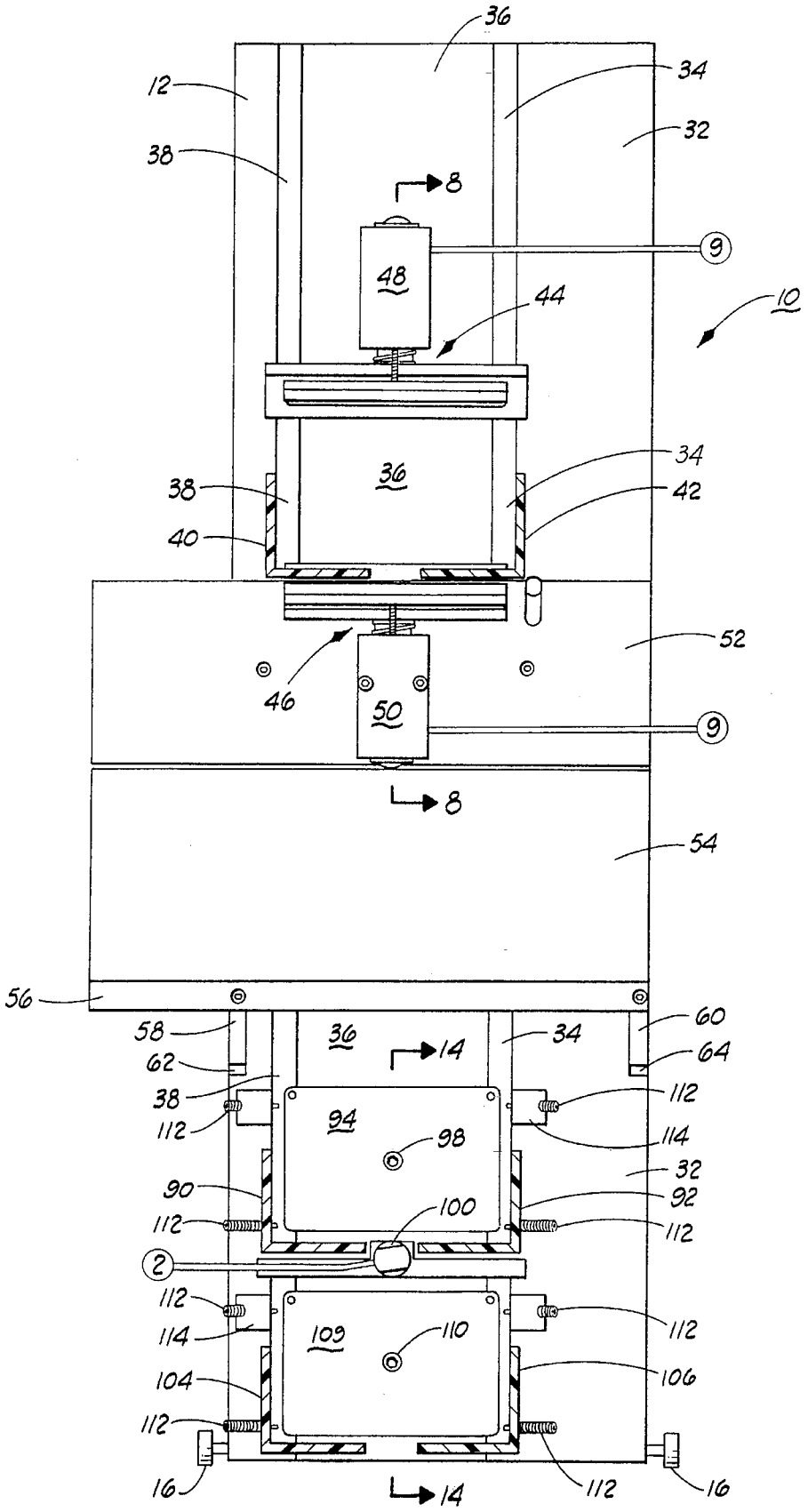
FIG. 1 is a plan view of the front panel of the testing apparatus.
Figure 2:
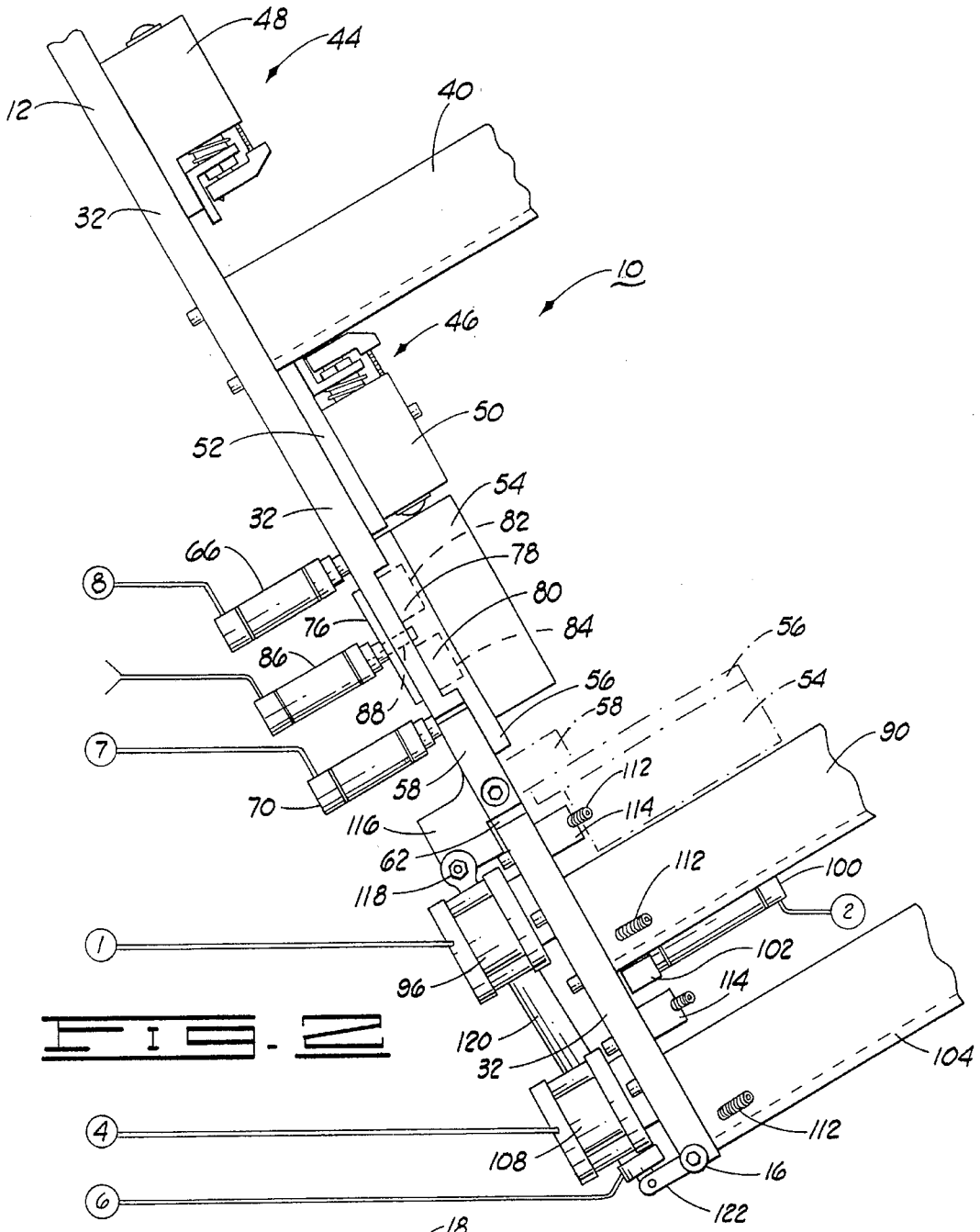
FIG. 2 is a side view in elevation of the front panel shown in FIG. 1.
Figure 3:
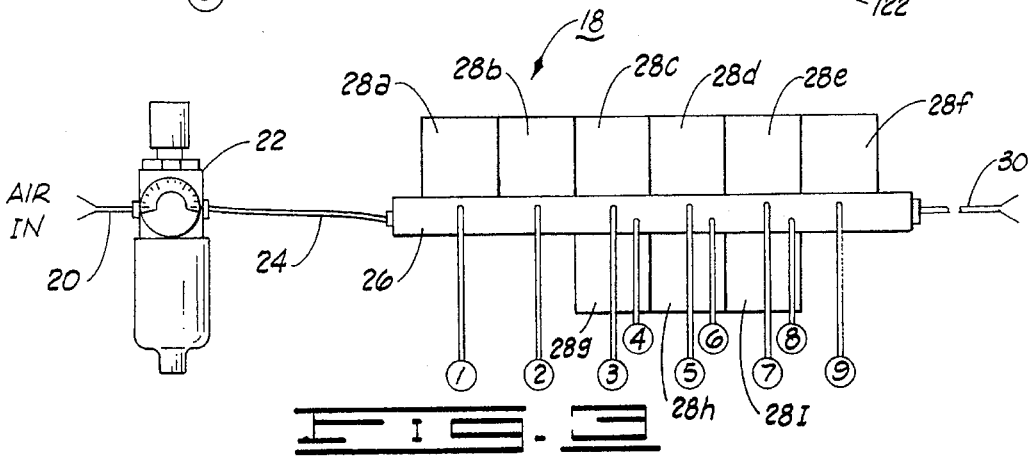
FIG. 3 is a depiction of an air regulator and solenoid valve bank employed in the test apparatus.

FIGS. 1 and 2 illustrate a modem handling apparatus 10. The modem handling apparatus 10 in operational attitude is disposed at an angle as shown in FIG. 2 as a right angularly shaped test machine housing (not shown) supports the chassis 12. The tester frame also houses the electronic circuitry (not shown) beneath the chassis 12 as the chassis 12 is rotatably supported on lower rollers 14 and 16 supported in the tester frame. When operationally assembled, the chassis 12 is detachably locked into the tester frame; however, the chassis 12 can be unlocked at the top and rotated forward and down to gain access to the circuitry and/or other structure contained behind the chassis 12. One such form of structure is a pneumatic supply 18 as shown in FIG. 3.

The air supply connector 18 is mounted behind the chassis 12 within the tester frame and receives air input from an external supply at conduit 20 connected to a commercially available type of air regulator 22. The air regulator 22 is a type capable of regulation between 10 and 100 psi and it is controlled to apply about 80 psi air under pressure via tube 24 to an air manifold 26. The air manifold 26 includes nine identical solenoid valves **28*a* through 28*i* which are actuatable to produce air pressure output on respective ones of tubes No. 1 through No. 9 that are applied to the testing apparatus 10 variously, as will be further described. Selective control of the solenoid valves 28***a* through 28*i* is effected via the multi-conductor cable input 30 which comes from the electronic circuitry (not shown). Most testing circuitry is supplied by the customer/user.

Referring again to FIGS. 1 and 2, the chassis 12 is structured around a chassis plate 32 that is milled to exhibit certain features. Thus, the plate 32 is milled to form a right hand guideway 34 along the length of plate 32, and it is further milled to form a wider slideway 36. The left hand side of chassis plate 32 is also formed with a first shallow milling of a guideway 38 which is then stepped down to the slideway 36. The slideway 36 is milled about 1/16th inch deeper than the guideways 34 and 38 and a pair of MYLAR™ TEFLON™ strips are overlai and 38 to aid the slidability of the modems.

Right angle track numbers 40 and 42 are disposed on each side of the plate 32 adjacent the outer edges of guideways 38 and 34 and secured by suitable fasteners to extend perpendicular therefrom. The angle tracks 40 and 42 are disposed to receive a plurality of modem cartridges for individual dispensing into the slideway 36 as will be further described. A pair of feed gate subassemblies 44 and 46 function coactively to move the individual modems into release position down the slideway 36, as will be further described. The feed gate subassemblies 44 consist of respective air cylinder assemblies 48 and 50 that are energized by the No. 9 air tubes coming from air supply 18. The cylinder assembly 48 is secured by bolting to the slideway 36 while the air cylinder assembly 50 is secured to a transverse plate 52 that is secured to each side of chassis plate 32 and bridging the slideway 36.

Immediately adjacent transverse plate 52 is a test box 54 which is arrayed transversely across the chassis plate 32. The test box 54 is mounted on a transverse test plate 56 (FIG. 2) which is hingedly affixed to the opposite side hinge arms 58 and 60 that are pivotally mounted within indentures 62 and 64 in opposite sides of the chassis plate 32. The test box 54 functions to seize and move a modem transversely into test connection from the slideway 36, as will be further described below. As can be seen in FIG. 2, the test plate 56 is actuatable into the 90° open position as shown by phantom lines as hinge plate 58 is elevated to its open position.

Figure 4:
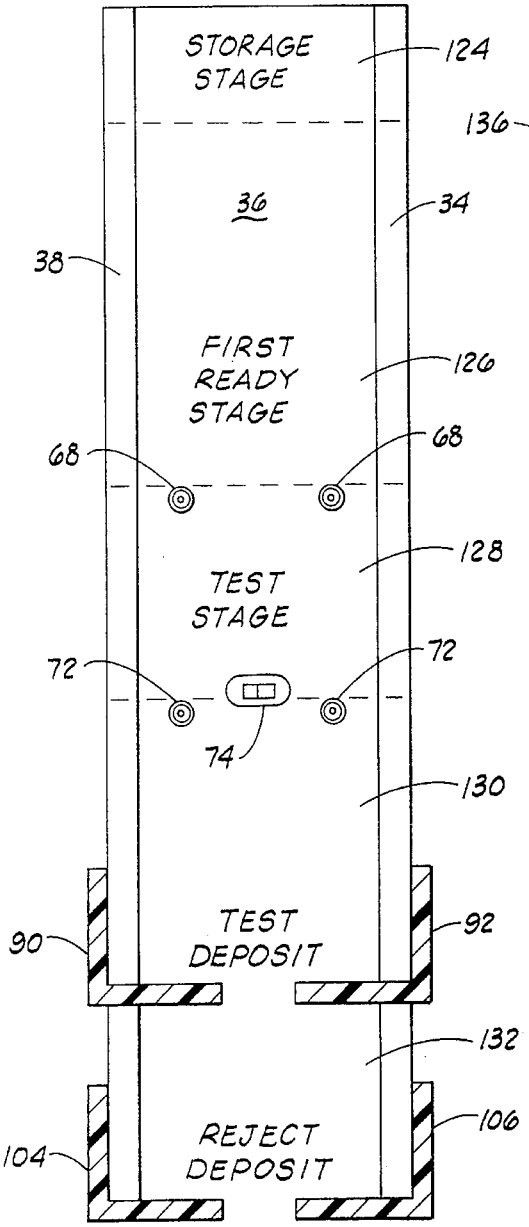
FIG. 4 is a functional diagram illustrating the testing stages of the apparatus.

On the underside of chassis plate 32 a pair of air cylinders 66 responsive to air control tube No. 8 are actuatable to extend cylinder pistons 68 upward into guideway 36 (see FIG. 4) so as to interfere with modem movement down the slideway 36. Pistons 68 hold a downward moving modem at a first ready stage 126 for a designated time. When the air cylinders 66 are released, i.e., pressure tube No. 8 is off, the modem is allowed to drop further into the test stage 128 beneath test box 54 whereupon a pair of air cylinders 70, responsive to air source tubes No. 7, are actuated to move respective pistons 72 into interfering position along slideway 36 to hold the modem at the test stage (FIG. 4). An optical sensor 74 provides indication to the test sequence controller that a modem is in proper transversely oriented position.

A guide foot 76 having opposite side guide blocks 78 and 80 is positioned along slideway 38 (see FIG. 9) so that alignment tabs 82 and 84 are normally positioned upward along slideway 38 thereby to align the plug edge of the modem prior to the transverse plug-in movement whereupon the tab ends 82 and 84 will be retracted. The guide foot 76 is moved by actuation of air cylinder 86. The piston 88 of air cylinder 86 is connected by a screw fastener to a portion 90 of chassis plate 32 that extends between guide feet 78 and 80. Thus, when air cylinder 86 is actuated, air cylinder 86 moves downward along with the guide member 76 so that the guide feet 78 and 84 cease interfering with transverse movement of the modem.

As shown in FIG. 1, a test position is defined by opposite side angle chutes 90 and 92 which receive all modems that test good, and properly tested modems are moved outward along angle chutes 90 and 92 by means of a pusher foot 94. Pusher foot 94 is timely controlled by an air cylinder assembly 96 (see FIG. 2) which is connected by a cylinder piston 99 and screw 98 (FIG. 14) under control of pneumatic pressure from tube source No. 1. In the event that the modem does not test good, pneumatic source No. 2 actuates an air cylinder 100 to retract a snubber foot 102 that allows the modem to pass on down the slideway 36 and into the reject deposit (see also FIG. 4) within angle chutes 104 and 106. When a modem is rejected down into angle chutes 104 and 106 an air cylinder assembly 108 connected to piston 111 (FIG. 14) is actuated via pneumatic source No. 4 to move pusher foot 109 and index the modem outward. The plurality of spring-loaded detents 112 are screw fastened at an angle into either the angle chutes 90, 92 and 104, 106 or they are positioned by means of securing blocks 114 affixed along the slideways 38 and 34. The particular types of detent mechanism are fully disclosed in U.S. Pat. No. 5,050,023.

A lever arm 116 (FIG. 2) is formed integral with hinge arm 60 (FIG. 1) to provide connection to a piston rod 118 of an air cylinder 120 (FIG. 2). The base of air cylinder 120 is pivotally connected to a bracket 122 extending from chassis plate 32. Thus, air cylinder 120 may be actuated to extend piston rod 118 thereby to rotate the hinge arms 58 and 60 upward to place the test box 54 in its 90° open position. This capability is desirable for maintenance and adjustment of the transverse positioning mechanism, as will be further described.

FIG. 4 illustrates in idealized form the length and stages of the gravity drop slideway 36. An uppermost storage stage 124 receives input of modems to be tested as they are stored in alignment in angle chutes 40, 42 (see FIG. 1) inclined for downward feed. The modems are fed by feed gate subassemblies 44 and 46 to fall against slideway 36 and opposite side glideways 38 and 34 thereafter to slide downward into the first ready stage 126. Pneumatic source No. 8 is then energized to actuate cylinders 66 to expel pistons 68 within the slideway so that the modem is stopped in slideway 36. Test stage 128 being empty, the cylinders 66 are then deactivated to withdraw pistons 68 and allow the modem to fall down to test stage 128 whereupon a pair of air cylinders 70 will have been activated to expel the pistons 72 and block further downward progression of the modem. An optical sensor 74 verifies proper positioning of the modem within test stage 128 whereupon the transverse slide mechanism is actuated to secure the modem for actual electrical testing, as will be further described below. After the test, the cylinders 70 are deactivated to withdraw piston 72 which allows the disconnected modem to fall on down slideway 36 into position in angle chutes 90 and 92. If the modem tested good, it remains in the angle chute 90 and 92; but, if the modem tested not good, the air cylinder 100 actuated by air source No. 2 allows the modem to fall further downward into the reject deposit angle chutes 104 and 106.

Figure 5:
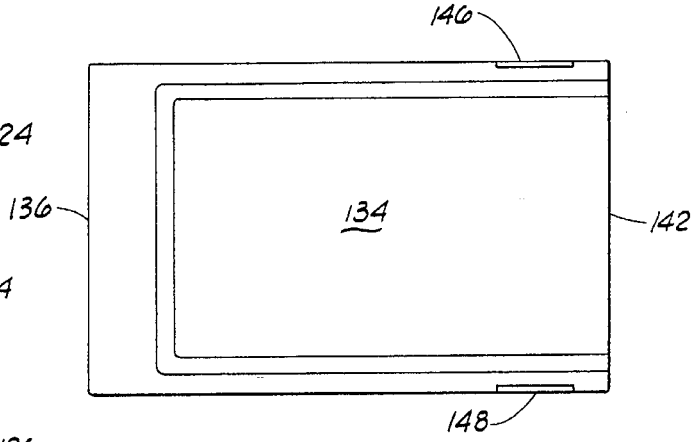
FIG. 5 is a top plan view of a standard modem wrapper.
Figure 6:
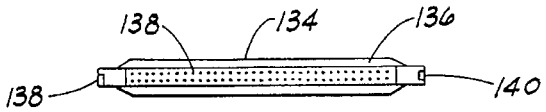
FIG. 6 is an end view of the modem of FIG. 5.
Figure 7:
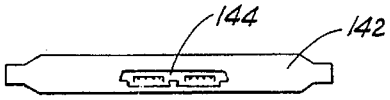
FIG. 7 is the opposite end view of the modem of FIG. 5.
Figure 5:
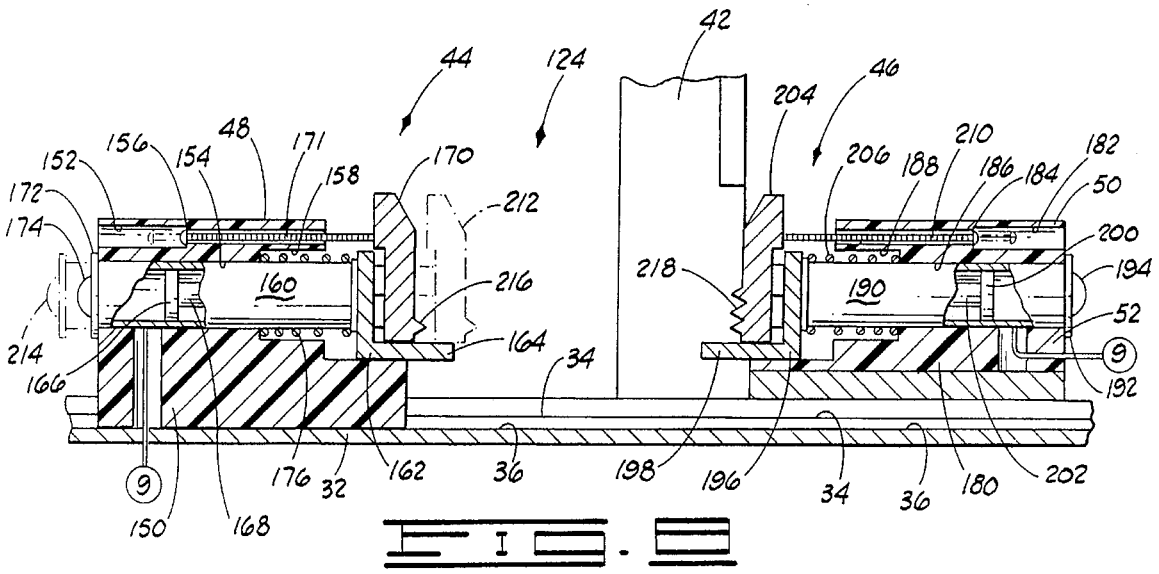

FIG. 5 illustrates a standard modem cartridge 134, a cartridge type that is utilized by most modem suppliers. FIG. 6 shows the first end 136 configurations, a large plurality of hole pairs 138. The opposite side keyways 138 and 140 and the number of hole pairs 138 may vary as between different modem manufacturers. FIG. 7 illustrates the second end 142 as it includes a limited number of configured contacts 144 and these too will vary with the different manufacturers. Opposite side energizing contacts 146 and 148 (FIG. 5) are disposed along each edge of the modem 134.

FIG. 8 illustrates a section taken along lines 8—8 of FIG. 1, a sectional view of the storage stage 124 and feed gate subassemblies 44 and 46. The air cylinder assembly 48 consists of a cylinder block 150 having a guide bore 152 and a cylinder bore 154. The guide bore 152 is counterbored to form a shoulder 156 there-within. The cylinder bore 154 is formed with a counterbore 158. The cylinder block 150 is seated by suitable fasteners to the slideway 36 of chassis plate 32.

An air cylinder 160 is coupled via tubing to air source No. 9 and is slidably retained within cylinder bore 154 as the cylinder 160 is secured to an angle plate 162 having a support plate 164 extending therefrom. The cylinder 160 has a piston 166 and rod 168 connecting to a clamping plate 170 as the opposite end of cylinder 160 includes a stop washer 172 as retained by a suitable screw fastener 174. A helical spring 176 is disposed around cylinder 160 within the counterbore 158 and tends to bias the cylinder 160 outward from bore 158.

The lower feed gate subassembly 46 is constructed in the same manner as subassembly 44 except that a shorter cylinder block 180 is used since the cylinder block 180 has to be secured on top of the transverse plate 52 defining the slideway 36 path therebeneath. Suitable fasteners (not shown) on each side of cylinder block 180 secure the block into transverse plate 52 and a suitable side emerging port is connected to the air source No. 9.

The remainder of feed gate subassembly 46 is constructed identically to subassembly 44, previously described. Thus, the cylinder block 180 includes an elongate guide bore 182 formed with an internal shoulder 184, and it is further formed with a cylinder bore 186 having a counterbore 188. A pneumatic cylinder 190 is slidably seated within cylinder bore 186 with a stop washer 192 secured by means of a screw fastener 194 on one end, and with the opposite end secured to an angle plate 196 having a support plate 198. The cylinder 190 includes a piston 200 and rod 202 that are connected through the angle plate 196 to a clamp plate 204. A helical spring 206 is seated around cylinder 190 within counterbore 188 to provide bias outwardly toward angle plate 196.

Each of the feed gate subassemblies 44 and 46 operates concurrently and in identical manner. A plurality of stacked modems resting in downward disposition between angle chutes 40 and 42 as cylinders 160 and 190 are actuated from air source No. 9 so that each of respective clamp plates 170 and 204 move toward the edges of the modem stack for limited movement, limited by the amount of slack in respective guide rods 171 and 210. Thus, when the heads of guide rods 171 and 210 reach the respective bore shoulders 156 and 184 their movement stops (as at dash line position 212) and the respective sliding cylinders 160 and 190 are forced to move slidingly in the opposite direction. Thus, as cylinder 160 moves to the position of dash lines 214 the angle plate 162 and support plate 164 are also retracted whereupon a single modem separated by plate teeth 216 and 218 drops down into the slideway 36 whereupon it is free to slide downward along the gravity drop route (beneath transverse plate 52). The feed gate subassembly 46 functions in the same manner at the same time in coaction with subassembly 44. Initial disclosure of the similar feed gate subassemblies is more fully set forth in the U.S. Pat. No. 5,050,023, aforementioned.

Figure 9:
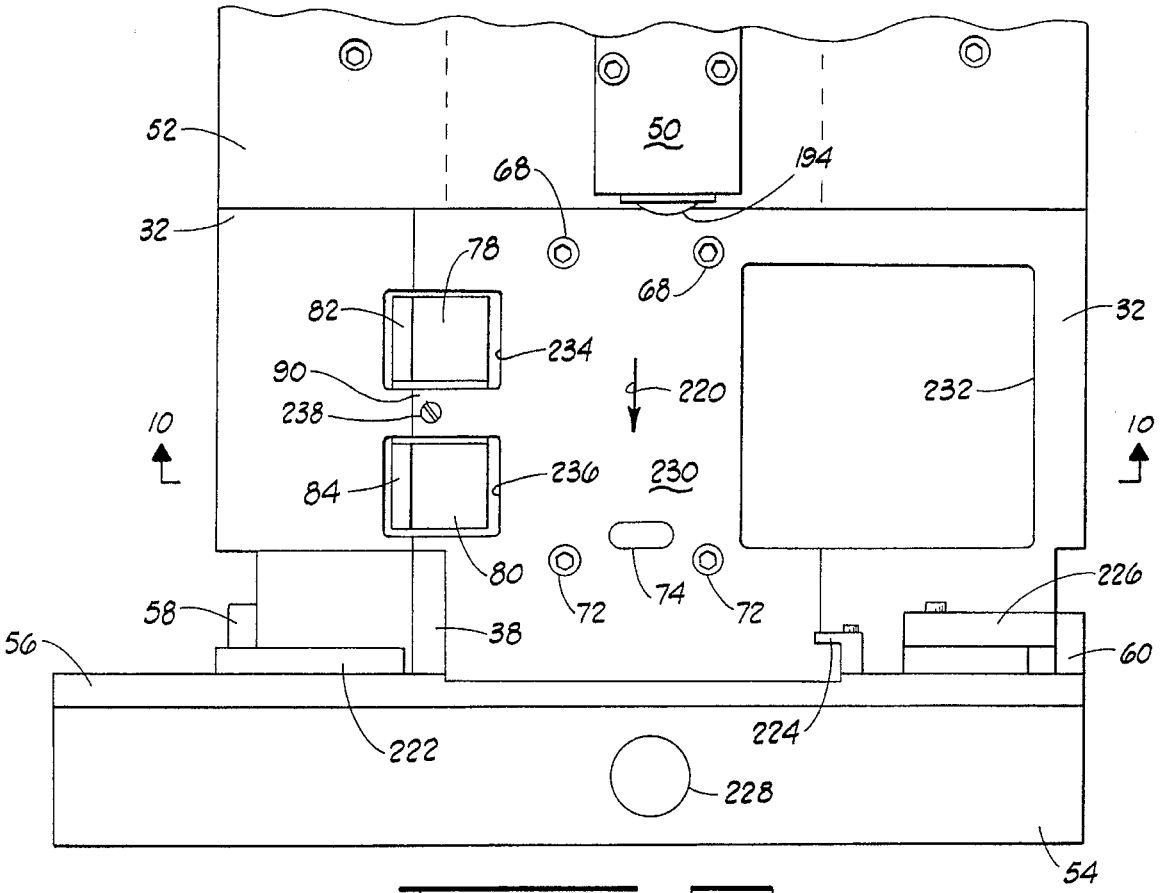
FIG. 9 is a plan view of a portion of the front panel of FIG. 1 with the transverse actuator in the open position.

FIG. 9 shows a plan view of the chassis plate 32, in the area of the test box 54, with the test box moved to its 90° upright position (as shown in phantom in FIG. 2). Downward modem traverse is indicated by arrow 220 and test box 54 is shown in its raised position exposing the various components on transverse test plate 56. These components are a test receptacle 222, a catch plate 224 and a driver assembly 226, all of which will be more particularly discussed with respect to FIGS. 11, 12 and 13. A hole 228 is formed in the forward wall of test box 54 to allow space for recoil of the screw fastener 194 when pneumatic cylinder 190 (FIG. 8) exhibits the recoil phase.

Figure 10:
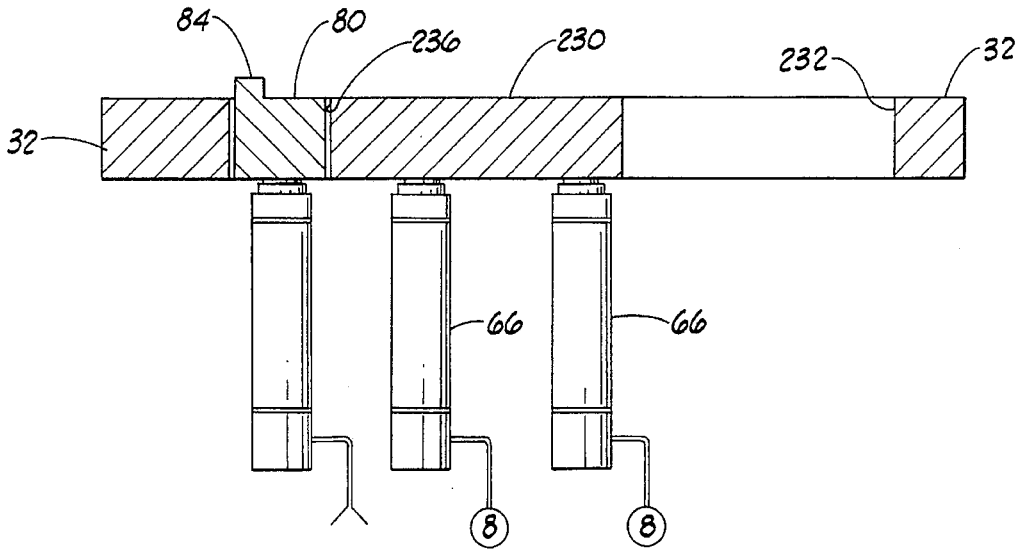
FIG. 10 is a vertical section taken long lines 10—10 of FIG. 9.

A transverse plate sector 230 of chassis plate 32 includes laterally spaced holes for receiving the pneumatic cylinder pistons 68 (cylinder assembly 66), and then below that the spaced pistons 72 from the pneumatic cylinders 70. The optical sensor 74 is positioned between and slightly above the level of cylinder pistons 72 which actuate to align the modem for the transverse plug-in movement. Referring also to FIG. 10, a hole 232 formed in chassis plate 32 provides space for catch plate 224 and driver assembly 226 when test box 54 is in its closed position. A pair of spaced square holes 234 and 236 allow for insertion of guide blocks 78 and 80 upward therethrough. Each of the guide blocks 78 and 80 are formed with respective alignment tabs 82 and 84 which serve to define the edge of the modem slideway in the sector 230. The guide blocks 78 and 80 are upward extensions of the guide foot 76 (FIG. 2) which is rigidly affixed to the air cylinder 86 while the air cylinder piston 88 is threadedly secured by screw 238 to the portion 90 of chassis plate 32. In this instance, the air cylinder 86 is secured to the guide foot 76 while the piston member is secured fast to portion 90 of chassis plate 32 so that actuation of air cylinder 86 extending the piston moves both cylinder 86 and guide foot 76 downward or away from chassis plate 32 thereby to move the alignment tabs 82 and 84 into non-interfering position relative to the surface of sector 230.

Figure 11:
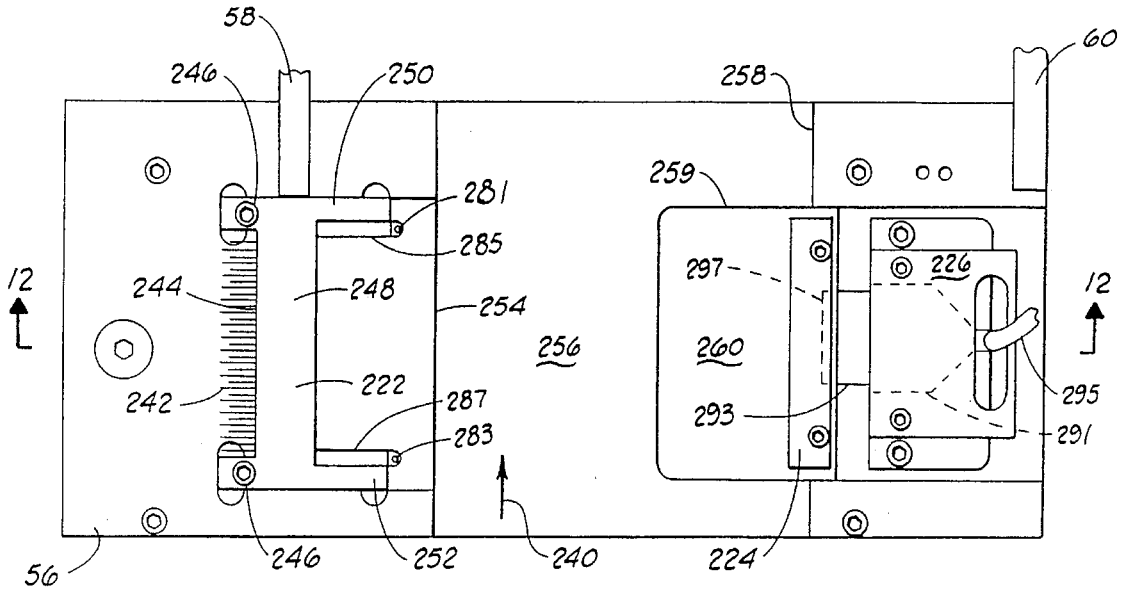
FIG. 11 is a plan view of the inside face of the transverse actuator.

FIG. 11 shows in plan view the normally downward oriented transverse test plate 56 as it would be viewed in the open position. Thus, when closed, the actual direction of modem gravitational drop would be in the direction of arrow 240 relative to test plate 56. Located on test plate 56 are the modem test receptacle 222, the catch plate 224 and the driver assembly 226.

Figure 12:
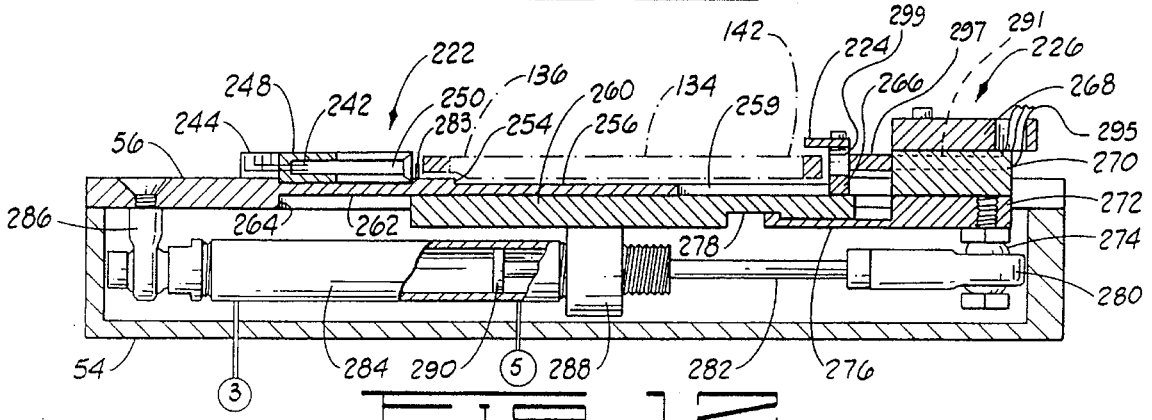
FIG. 12 is a vertical section taken along lines 12—12 of FIG. 11.

The test receptacle 222 receives the first end 136 of the modem which presents a large plurality of hole pairs 138 (see also FIG. 12). The receptacle 222 carries a matching plurality of pins 242 which extend into a connector socket 244. A suitable connector providing all of the requisite test connections is connected to socket 244, and a multi-conductor cable is then led back behind the chassis for connection to the electronic circuitry (not shown). The test connection circuitry and connector will vary with each different type of modem and the modem test receptacles 222 are interchangeable as secured by allen screws 246. As shown also in FIG. 12, the test receptacle 222 includes a central receptacle 248 and opposite side guides 250 and 252 which are each keyed to match the side key ways 138 and 140 of the particular modem unit.

The test plate 56 is then milled to a second level along line 254 to define a slide sector 256 whereupon plate 56 resumes its original plane along milling line 258. A cut out 259 of generally rectangular dimension is made in test plate 56 to form a slideway for the catch plate 224 and driver assembly 226 which extend upward therethrough. As shown in FIG. 12, a slide plate 260 is adapted to slide beneath test plate 56 in a milled out slideway 262 terminating in a stop wall 264. The other end of slide plate 260 has an upright plate 266 which supports the catch plate 224 thereon that presents an overhang facing toward the test receptacle 222.

The driver assembly 226 includes a top plate 268 secured on top of a spacer plate 270 which is fastened on a pivot plate 272 that carries a pivot connector 274 threadedly secured thereunder. The forward portion of pivot block 272 is formed to include a stop plate 276 which extends into sliding, interlocking engagement within a transverse slot 278 formed on the underside of slide plate 260. The pivot post 274 is connected to a socket connector 280 secured on piston rod 282 of a pneumatic cylinder 284. The cylinder 284 is anchored within test box 54 by means of support fasteners 286 and 288, and air is provided from air sources No. 5 and No. 3 to respective sides of the air piston 290.

The spacer plate 270 includes a horizontal slot 291 which carries a key plug 293, a multi-pin, keyed plug for insertion in the configured contact receptacle 144 of the modem end 142. Key plug 293 is connected to a multi-conductor cable 295 and a forward end 297 is shaped to fit through a horizontal slot 299 (FIG. 12) in upright plate 266 of catch plate 224. Thus, with initial closure actuation of cylinder 284, the key plug 293 is engaged with modem receptacle 144.

Figure 13:
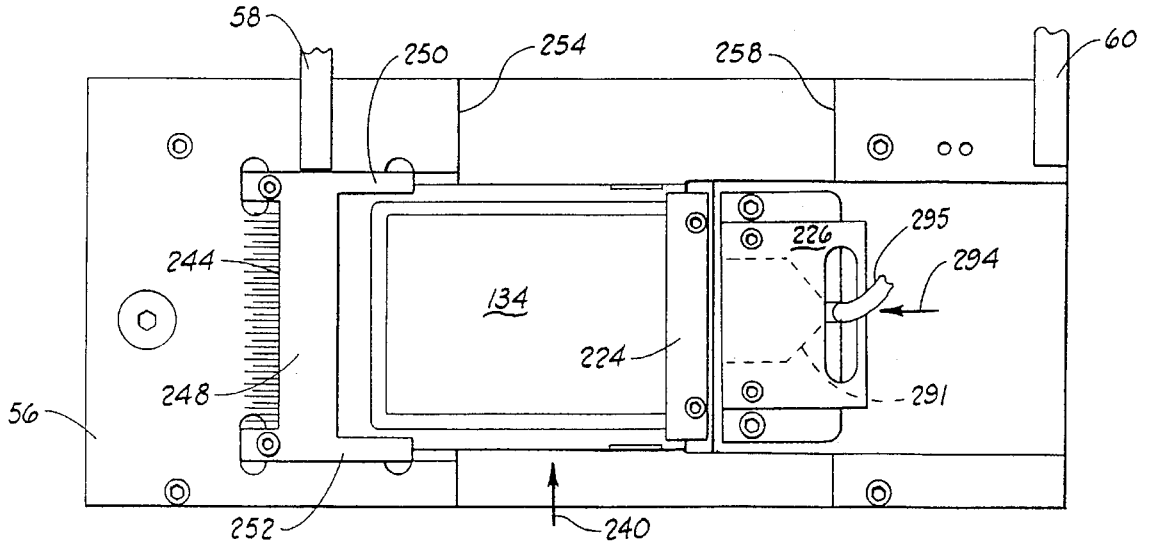
FIG. 13 is a view of the inside face of the transverse actuator in actuated position carrying the modem into pin connection.

FIG. 12 shows the test box 54 in its full open position as air cylinder piston rod 282 is fully extended to carry driver assembly 226 fully to the right, while the stop plate 276, inter-locking in slot 278, pulls the slide plate 260 fully to its rightward extent. Modem 134 (dash lines) then slides down into slide sector 256 (FIG. 11). Keep in mind that during operation the test plate 56 is closed against slideway sector 230 of chassis plate 32 (see FIG. 9) and the modem 134 slides downward in the direction of arrow 240 to its position as shown in FIGS. 11 and 12. Air source No. 5 is then energized to drive the piston 290 to retract the piston rod 282 which begins the transverse movement of driver assembly 226. As the extension rod 282 is retracted, driver assembly 226 moves leftward until the extension stop plate 276 locks into abutment in slot 278 whereupon the key plug forward end 297 is engaged in modem receptacle 144. Thereafter, both driver assembly 226, slide plate 260 and catch plate 224 proceed leftward to engage the modem 134. As piston 290 and piston rod 282 continue to full closure, as shown in FIG. 13 indicating the transverse movement by arrow 294, the catch plate 224 captures over the second end 142 of modem 134 to move the first end 136 into the respective edge guides 250 and 252 (FIG. 11) and, finally, into pin/hole engagement of pins 242 in central test receptacle 248. Pins 281 and 283 extending from slide plate 260 through respective slots 285 and 287 are carried into the central receptacle 248 by the modem front edge during transverse closure of slide plate 260. Then, on reversal of slide plate 260, the pins 281 and 283 function initially to disengage the modem hole array 138 from the receptacle pins 242. FIG. 13 illustrates the modem 134 when finally carried transversely into its pin-connected test position whereupon a series of automatically and/or purposefully effected circuit tests are made by means of the connector (not shown) which is placed on socket 244.

When the test is complete, air pressure is applied from source No. 3 to urge piston 290 rightward thereby to extend the piston rod 282 and start the traverse of driver assembly 226. The initial transverse movement for approximately the length of slot 278 beneath slide plate 260 disengages holes 138 by means of pins 281 and 283 and continued transverse movement of slide plate 260 to traverse the length of slideway 262 effects total disengagement from test receptacle 222 and withdrawal of the modem 134 to the slideway sector 256 (FIG. 12) whereupon the modem 134 is free to drop, under force of gravity, into the test and/or reject deposits.

Figure 14:
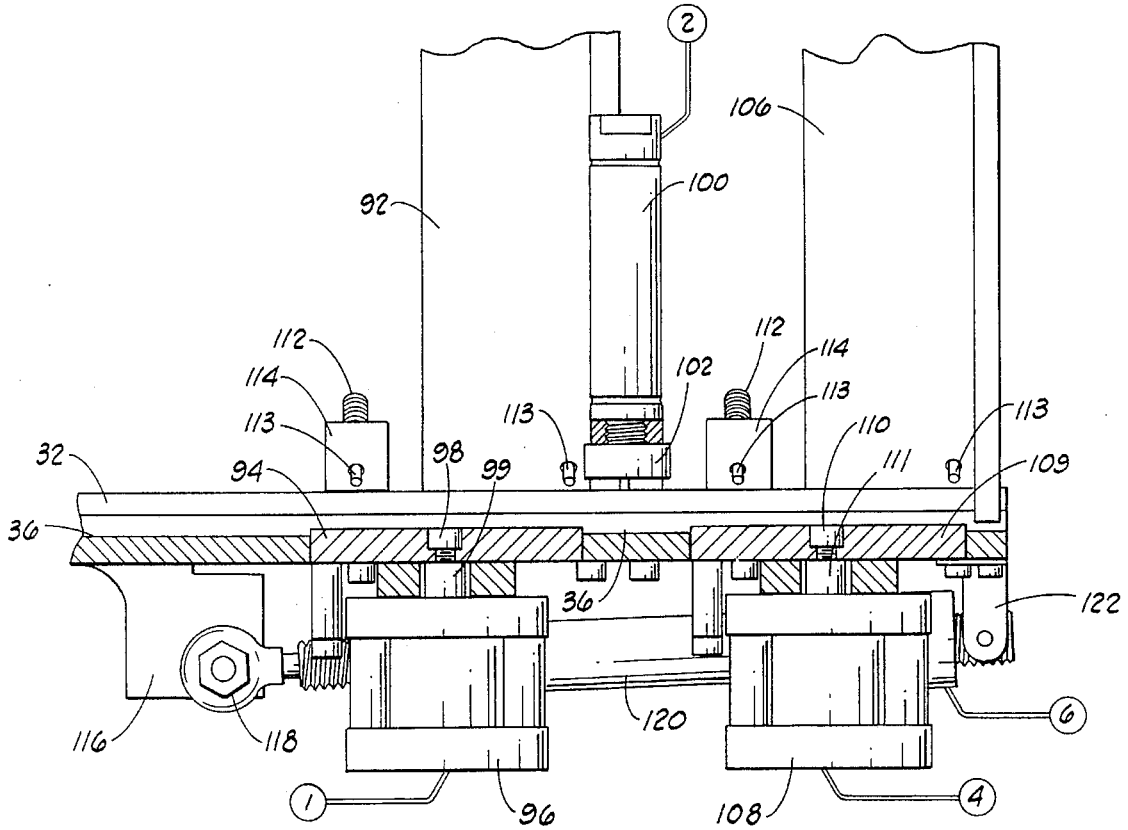
FIG. 14 is a vertical section taken along lines 14—14 of FIG. 1.

FIG. 14 illustrates the structure of the test deposit stage 130 and reject deposit stage 132. Tested modems slide under gravitational force down slideway 36, and if the unit tested good, air cylinder 100 will be activated to extend rubber snubber 102 adjacent the slideway 36 to stop the fall of a tested modem 134. The air cylinder assembly 96 is then energized from air source No. 1 to extend piston member No. 99 and pusher foot 94 thereby to move the modem unit past the detents 113 and into the right angle tracks 92 and 90 (see also FIG. 1). In the event that the modem does not test good, the air cylinder 100 is not actuated thereby to withhold rubber snubber 102, and allow the down-falling modem to fall on down to the lower level adjacent the right angle tracks 104 and 106. The air cylinder assembly 108 is then activated from air source No. 4 to extend piston 111 and pusher foot 109 thereby to move the failed modem past the detents 113 into the reject deposit storage of angle tracks 104 and 106.

The foregoing discloses a novel modem handling apparatus that enables rapid and efficient test procedures to be performed on individual modem units. The apparatus uses a gravity conveyance system for moving individual modems from a storage stage through test stages to final deposit, either test or reject classified. The testing apparatus has a cycle time that is somewhat under two seconds. That is, the time required for the apparatus to handle the modem through its traverse and plug-in stages, and any variations in time greater than the basic cycle time will be that time required to perform the test procedures as entered by the customer or utilizer of the testing apparatus. There is a great variety of modem plugs which are also selected by the customer user for the particular modem device and changeable components may readily be employed in the operation.

It should be understood that the present apparatus might be used for conveyance and handling of a wide variety of PC cards and similar products. While the device as disclosed functions using pneumatic control and actuation components, either hydraulic or electro-mechanical equivalents may be utilized.

Changes may be made in the combination and arrangement of elements as heretofore set forth in the specification and shown in the drawings; it being understood that changes may be made in the embodiments disclosed without departing from the spirit and scope of the invention as defined in the following claims.

What is claimed is:

1. Apparatus for handling PC card units during testing procedures, comprising:

a chassis plate supported at an incline, said chassis plate being milled out to form a slideway along the length thereof for slidably receiving PC cards to be tested;

means for releasing said PC cards into said slideway with plug edges facing transversely to said slideway;

a test box disposed across said chassis plate and including a PC card test receptacle on a first side, a generally central slideway sector receiving a card thereon, and a transversely slidable catch plate and drive assembly normally disposed on the second side;

a fluid actuator connected between the test box first side and said driver assembly and actuatable to draw said driver assembly and catch plate transversely to capture said PC card in said slideway sector and carry the card further transversely into testing pin connection in said card test receptacle;

means for reversing actuation of said fluid actuator to disconnect the card pin connections and return the card to the slideway to proceed downward therein; and deposit means disposed on said slideway to classify tested PC card units into valid tested units and rejected units.

2. Apparatus as set forth in claim 1 wherein said means for releasing comprises:

first and second angle chutes disposed on each side of said slideway and perpendicular thereto, said angle chutes holding a plurality of PC cards stacked on long dimension edge;

first feed gate means disposed on said slideway; and second feed gate means disposed on a plate bridging said slideway and operating in coaction with said first feed gate means to separate and release singly said PC cards down said slideway.

3. Apparatus as set forth in claim 2 which further includes:

linear actuator means disposed below said chassis plate and actuatable into interfering position in said slideway to hold said PC card at a ready stage above said test box.

4. Apparatus as set forth in claim 3 wherein:

said PC cards are modems.

5. Apparatus as set forth in claim 2 which further includes:

second linear actuator means disposed below said chassis plate and actuatable into interfering position in said slideway to hold said PC card at a test stage adjacent to said test box slideway sector.

6. Apparatus as set forth in claim 1 which further includes:

linear actuator means disposed below said chassis plate and actuatable into interfering position in said slideway to hold said PC card at a ready stage above said test box.

7. Apparatus as set forth in claim 1 which further includes:

second linear actuator means disposed below said chassis plate and actuatable into interfering position in said slideway to hold said PC card at a test stage adjacent to said test box slideway sector.

8. Apparatus as set forth in claim 7 wherein said deposit means comprises:

upper deposit chutes disposed on each side of said slideway;

selection linear actuator means disposed in said slideway and actuatable to allow further fall of defective PC cards;

a first pusher foot disposed co-planar with said slideway adjacent said upper deposit chutes; and a first pusher linear actuator actuatable to urge valid tested PC cards into said upper deposit chutes.

9. Apparatus as set forth in claim 8 which further includes:

lower deposit chutes disposed on each side of said slideway below said selection linear actuator;

a second pusher foot disposed co-planar with said slideway adjacent said lower deposit chutes; and a second pusher linear actuator actuatable to urge rejected PC cards into said lower deposit chutes.

10. Apparatus as set forth in claim 1 wherein said deposit means comprises:

upper deposit chutes disposed on each side of said slideway;

selection linear actuator means disposed in said slideway and actuatable to allow further fall of defective PC cards;

a first pusher foot disposed co-planar with said slideway adjacent said upper deposit chutes; and a first pusher linear actuator actuatable to urge valid tested PC cards into said upper deposit chutes.

11. Apparatus as set forth in claim 10 which further includes:

lower deposit chutes disposed on each side of said slideway below said selection linear actuator;

a second pusher foot disposed co-planar with said slideway adjacent said lower deposit chutes; and a second pusher linear actuator actuatable to urge rejected PC cards into said lower deposit chutes.

12. Apparatus as set forth in claim 1 wherein:

said PC cards are modems.

13. Apparatus as set forth in claim 1 wherein said test box driver assembly comprises:

a slide plate pivotally connected to said fluid actuator and having said catch plate and drive assembly secured thereon;

a key plug receiving electrical test signals, said key plug being retained in said drive assembly and directed through said catch plate toward the PC card key receptacle so that actuation of the fluid actuator moves the key plug into contact with the key receptacle.

* * * * *

UNITED STATES PATENT AND TRADEMARK OFFICE

CERTIFICATE OF CORRECTION

PATENT NO. : 5,611,436

DATED : March 18, 1997

INVENTOR(S) : Harrel D. Ashby

It is certified that error appears in the above-indentified patent and that said Letters Patent is hereby corrected as shown below:

Column 3, line 17, insert --or-- between "MYLAR™" and "TEFLON™" and delete "overlai" and substitute --overlaid on the guideways 34-- therefor.

Signed and Sealed this

Seventeenth Day of June, 1997

Bruce Lehman

*Attest:*

BRUCE LEHMAN

*Attesting Officer*

*Commissioner of Patents and Trademarks*